US005715808A

United States Patent [19]

Wilhoite

[11] Patent Number: 5,715,808

[45] Date of Patent: Feb. 10, 1998

[54] DIRECT VENT FIREPLACE

[75] Inventor: Murray O. Wilhoite, Franklin, Tenn.

[73] Assignee: Temco Fireplace Products, Inc., Nashville, Tenn.

[21] Appl. No.: 676,584

[22] Filed: Jul. 8, 1996

[51] Int. Cl.[6] ..... F24C 3/00

[52] U.S. Cl. ..... 126/85 B; 126/512

[58] Field of Search ..... 126/85 B, 512

[56] References Cited

U.S. PATENT DOCUMENTS

| | | | |
|---|---|---|---|
| 3,052,230 | 9/1962 | Conrad | 126/85 B X |
| 3,435,816 | 4/1969 | DeWerth | 126/85 B |
| 3,654,913 | 4/1972 | Derringer et al. | 126/85 B X |
| 5,471,973 | 12/1995 | Wilhoite | 126/512 X |

*Primary Examiner*—Larry Jones

*Attorney, Agent, or Firm*—Alan Ruderman

[57] ABSTRACT

A direct vent fireplace has a mounting assembly for aiding in the installation of a vent cap assembly through which fresh air is drawn for combustion and exhaust gas products are expelled from the fireplace. The assembly includes a wall mounting box having a plate which may be secured to a pair of spaced apart framing studs of an interior wall adjacent to which the fireplace is to be installed. The wall box includes two members which are telescopically connected together so that the length from the plate to rear surface of the box may be adjustably selected to be equal to the thickness of an exterior wall through which the air enters and the flue gases exhaust. The vent cap assembly includes a plate which is secured to the rear end of the box after the box has been installed. Adjustable length flue gas and air tubes are received through the box and connect the event cap assembly to the fireplace.

3 Claims, 4 Drawing Sheets

DIRECT VENT FIREPLACE

BACKGROUND OF THE INVENTION

This invention relates to fireplaces of the direct vent type and more particularly to an exhaust gas vent and air inlet duct mounting system for permitting the fireplace including the ducting to be installed during the framing stage of a building structure without requiring the installer to return after the interior and exterior walls are in place to complete the installation.

In direct vent fireplaces of the type illustrated in Wilhoite U.S. Pat. No. 5,471,973, the firebox, i.e., the combustion chamber or housing within which the hot flue gases are generated, vents directly through an outside wall to the exterior of the building in which the room is located and receives fresh air which supports combustion from an air inlet concentric with the exterior exhaust vent. Room air is dram into the front of the fireplace below the firebox, rises above the firebox over the top and exhausts at the front. As the room air flows about and over the firebox, it is heated so that it enters the room as heated air. An array of artificial logs or the like is disposed within the firebox and gas, such as natural gas or propane, may be ignited to create a flame which in conjunction with the logs simulates the aesthetics of actual burning logs. A vent cap at the end of the flue pipe at the exterior of the building closes off the hot gases exiting the flue pipe and diffuses the flue gases by a baffle in the vent cap assembly.

The fireplace is installed in the building after the framing and before the interior walls are completed. The fireplace includes first and second collars corresponding respectively to an air box inlet for receiving the fresh air and to the flue gas exit pipe from the firebox baffle. These collars mount directly to an intake air tube and to the exhaust gas tube of the vent cap assembly. The vent cap assembly in the prior art is attached to a flat plate that is fastened to the exterior wall of the building and the vent cap is inserted into the air intake tube and over the exhaust gas vent tube. However, the vent cap cannot be installed until after the exterior wall has been constructed and this is after the insulation has been installed. Thus, the installer cannot complete the installation of the fireplace in a single trip to the job site. The installer must return for a second trip to the job sight to install the vent cap after the fireplace has been installed in the building during the first trip. Additionally, the mounting plate of the vent cap must be mounted so as to prevent water from entering the wall. If the exterior wall is not flat, e.g. shiplapped siding, etc. or less than a given thickness, e.g. five inches, wood strips must be used to build up a flat surface. Corking compound may be required to complete the installation. If the wall is brick, masonry or stucco, lag screws or expanding anchor bolts may be required. Since a fireplace installer is not a specialist in sealing exterior walls from water or the like, it would be best to be able to have the fireplace together with the vent cap installed in a single trip to the job site and have the exterior wall completed thereafter by the exterior wall contractor.

SUMMARY OF THE INVENTION

Consequently, it is a primary object of the present invention to provide a vent cap assembly that can be installed when the fireplace is installed during the framing stage so as to avoid a second trip to the building job site in which the fireplace is installed.

It is another object of the present invention to provide apparatus for installation of the vent cap assembly to a direct vent fireplace without requiring the vent cap assembly to be fastened to an exterior wall.

It is a further object of the present invention to provide a wall box adapted to be connected to the studs of a wall at the interior of a structure within which a direct vent fireplace is to be installed, the wall box terminating at the surface of the exterior wall, whether or not the exterior wall is in place, and the vent cap assembly being adapted to be connected to the rear of a wall box.

Accordingly, the present invention provides a direct vent fireplace including adjustable length flue gas and air inlet tubes and having a wall box positionable on the flaming studs at the interior of the structure within which the fireplace is to be installed, the wall box having an adjustable length and a rear end extending to a location substantially even with the surface of the exterior wall, and a vent cap assembly disposed outside the structure and the exterior wall and securable to the rear end of the wall box. The wall box thus permits the vent cap assembly to be installed when the fireplace is installed so that a second trip to the job site is not required.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
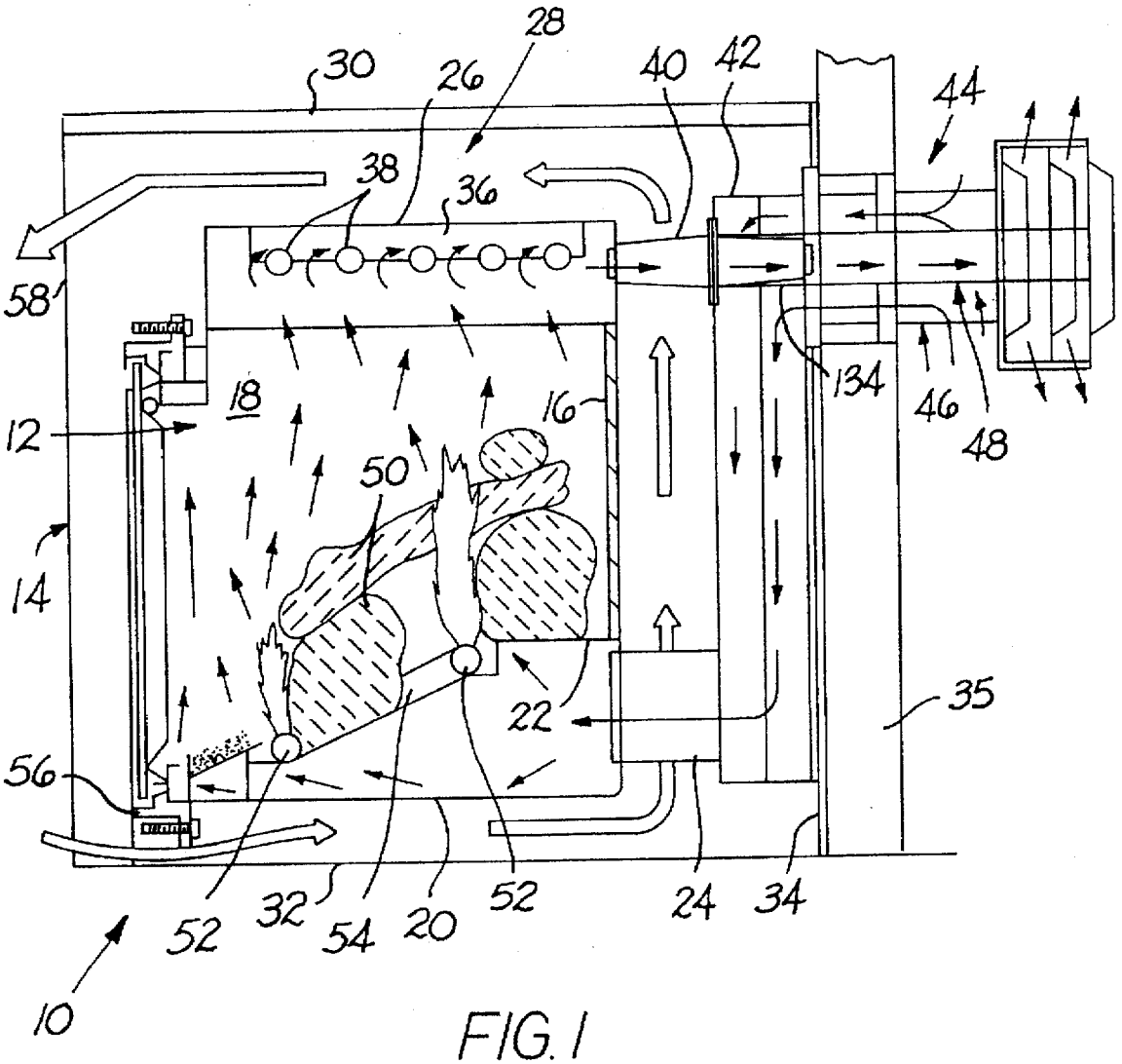
FIG. 1 is a vertical cross sectional view taken through a direct vent fireplace in accordance with the present invention.
Figure 2:
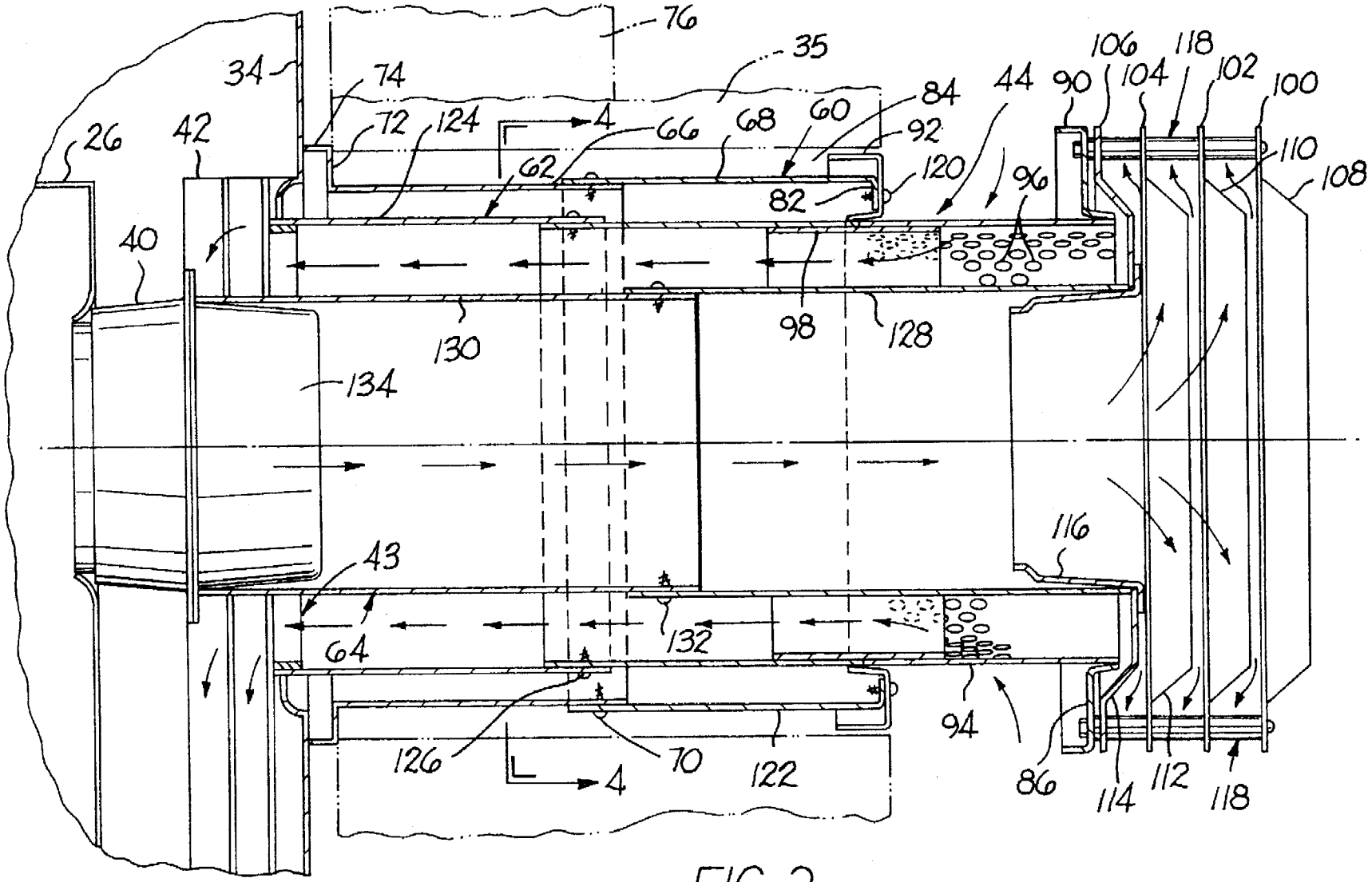
FIG. 2 is an enlarged cross sectional view of a portion of FIG. 1 illustrating the air inlet and flue gas portions of the direct vent fireplace.

Referring to the drawings, a direct vent fireplace 10 is illustrated in FIG. 1 having a fire box 12 in the form of a metal box including a door 14 for closing an open front, and having a rear wall 16 and side walls 18 (only one of which is illustrated) welded thereto, the interior walls preferably including refractory or firebrick surfaces. Disposed on a bottom plate 20 welded to the rear and side walls and which may, if desired, also include refractory bricks, is a log support structure or grate 22 which also provides a baffle for combustion air which enters beneath the grate 22 from an air duct 24. The fire box also includes a top wall 26 welded to the rear and side walls. The fire box 12 is disposed within an outer chamber 28 including a top wall 30, a bottom wall 32 and a rear wall 34 which may abut or be spaced from an outside wall 35, as illustrated in FIG. 2, of the room within which the fireplace is located, and side walls (which are not illustrated). A substantially U-shaped baffle 36 is disposed at the top of the fire box 12, the bottom of the baffle facing the interior of the fire box and being closed while the legs are welded to the top wall 26. The hot flue gases within the fire box rises and enters the interior of the baffle 36 through openings 38 in the baffle legs and enter a flue gas outlet 40 which communicates with the interior of the baffles 36, extends through an air box 42, and exits through the rear wall 34 through the vent cap assembly 44 hereinafter to be described.

Fresh outside air for supporting combustion is drawn into an air inlet air assembly 46 which is part of the vent cap assembly and is coaxially disposed about an exhaust gas outlet 48 which also forms a portion of the vent cap assembly as hereinafter described, and enters the air box 42 through an inlet pipe 43. The air box 42 is merely a sheet metal box which receives air from the air pipe tube 46 and supplies the air to the air duct 24. Thus, fresh outside air for supporting combustion enters the combustion chamber beneath artificial logs 50 supported on the grate 22. Gas fuel, such as natural gas, propane, or the like is supplied to burners 52 through gas ducts 54 and is ignited to create the hot combustion products which exit at the top of the fire box through the baffle 36 and exhaust pipe 40 as heretofore described.

Room air from the room within which the fireplace is disposed enters the outer chamber 28 of the fireplace through a grill 56 at the bottom front end and flows between the bottom wall 32 of the chamber and the bottom plate 20 of the fire box. This room air rises upwardly while being heated between the rear wall 16 of the fire box and the rear wall 34 of the chamber 28, and between the side walls of the fire box and the side walls of the chamber 28. As the room air passes over the fire box and the exhaust pipe 40, it is heated so that as it reaches the space between the top wall 26 of the fire box and the top wall 30 of the chamber, it has been heated and exhausted through a vent 58 at the top front end of the chamber 28 into the room.

Figure 5:
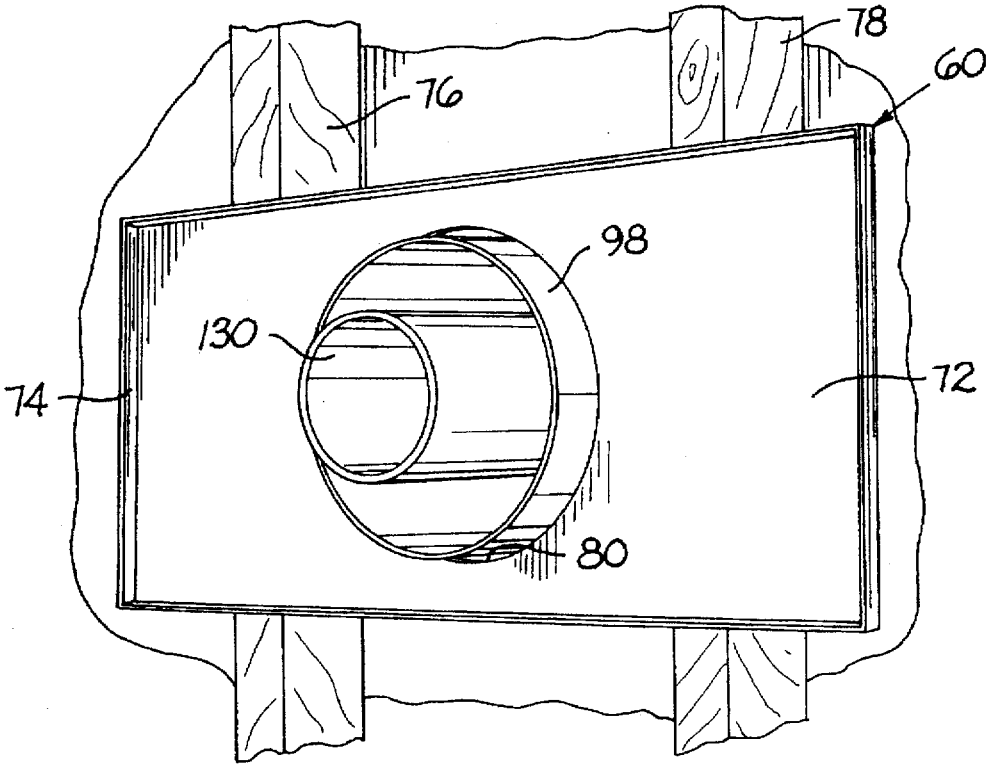
FIG. 5 is a perspective view of the air box as viewed from the interior of the structure with the fireplace removed and illustrating portions of the vent cap inlet and vent cap exhaust assemblies.

In accordance with the present invention there is provided an adjustable length wall box 60 together with an adjustable length air inlet tube 62 and an adjustable length flue exhaust tube 64 in conjunction with the vent cap assembly 44. The wall box 60 comprises two rectangular sheet metal boxes 66, 68 one of which, e.g. interior box 66 is telescopically received within the other, the boxes being secured together by screws 70. The inner box 66 includes an integral enlarged plate 72 at its front end as best illustrated in FIG. 5, the plate 72 having a peripheral flange 74 facing inwardly and against which the rear wall 34 of the fireplace abuts. The plate 72 is secured to two studs 76, 78 forming the framing for the wall 35 against which the fireplace is disposed. The plate 72 has a circular opening 80 disposed between the studs 76, 78 when the plate is properly installed.

Figure 3:
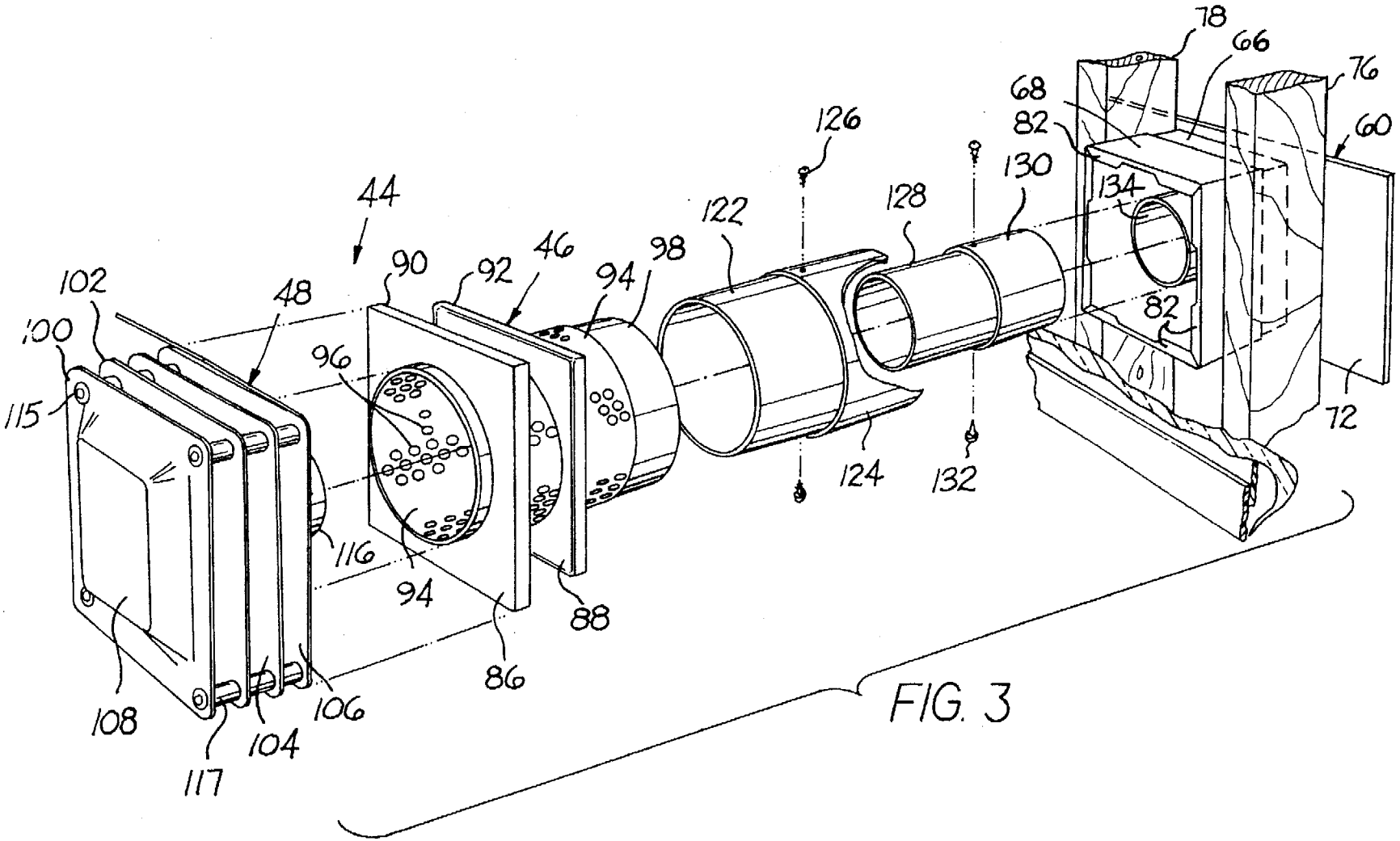
FIG. 3 is an exploded perspective view of the air box together with the vent cap inlet and the vent cap exhaust assembly.
Figure 4:
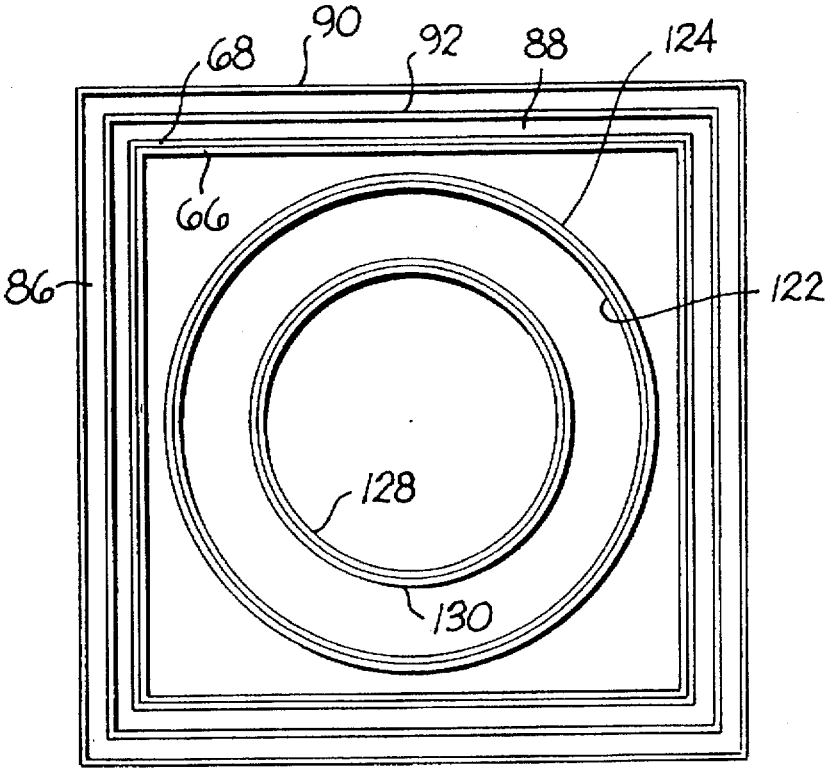
FIG. 4 is a cross sectional view taken substantially along line 4—4 of FIG. 2.

The outer box 68 is open at the rear end and has tabs 82 bent inwardly from the walls, as best illustrated in FIG. 3. The boxes 66 and 68 are secured together so that the combined length is such that the distance from the plate 72 to the tabs 82 is substantially equal to the thickness of the wall 35 whether the wall is in place or whether the wall 35 is not yet constructed. If the wall 35 is in place, then of course, an opening 84 must be cut for receiving the box. If the wall is not yet in place then the boxes are assembled to a length substantially equal to that of the proposed thickness of the wall 35. The latter situation will eliminate the fireplace installer from returning to the job site to install the vent cap assembly 44 after the fireplace has been installed, as hereinafter described.

As aforesaid, the vent cap assembly 44 comprises the vent cap inlet assembly 46 and the vent cap outlet assembly 48. The cap inlet assembly includes a pair of rectangular metal plates 86, 88 having respective flanges 90, 92, the plate 86 being larger than the plate 88. The flange 90 faces toward the plate 88 while the flange 92 faces away from the plate 86. Both plates have a central circular opening within which a cylindrical tube 94 is disposed and secured to both plates by welding or the like so that the plates are spaced apart. The tube 94 has perforations 96 so that air may enter into the tube from the exterior of the tube. The tube 94 may be unitary or have an extension 98 extending remotely from the plates 90, 92.

The vent cap outlet assembly 48 comprises a plurality of sub-assemblies each comprising a rectangular plate 100, 102, 104, 106 to which a respective truncated pyramid shaped cap 108, 110, 112, 114 is fastened as by locking tubes 115 which extend through spacer tubes 117. The plates 102, 104, 106 and the caps 112 and 114 have a central opening. A flue gas outlet pipe 116 having a diameter smaller than that in the plates 102, 104 and cap 112 extends through the opening in the plate 106 and is secured within the opening in the cap 114. Thus, the assembled vent cap outlet assembly 48 acts to baffle the hot flue gases entering the pipe 116 from the fireplace exhaust outwardly from the assembly between the plates 104, 106 and the plates 102, 104. The additional plates 100 and cap 108 are utilized so that the exterior cap, i.e., cap 108, is not excessively hot relative to the cap 110 so as to prevent dangerous burns if a person should contact the cap. In order to assemble the plates 108, 110, 112, 114 together, elongated screw means 118 extends through all the plates and into the plate 86 of the vent cap inlet assembly, the screw means being secured by nuts so that the vent cap inlet assembly and vent cap outlet assembly comprise a unit, i.e., the vent cap assembly 44.

The assembled vent cap assembly is fastened to the wall box 60 by securing the plate 88 to the tabs 82 at the rear of the wall box, screws 120 acting to secure them together.

The air tube assembly 62 comprises two tubes 122, 124 telescopically receivable one within the other and secured together by screws 126 to provide a length substantially equal to the distance between the inlet pipe 43 of the fireplace air box 42 and the exterior surface of the wall 35. Similarly, the flue gas assembly 64 comprises two tubes 128, 130 telescopically receivable one within the other and secured together by screws 132 to provide a length substantially equal to the distance between the front of a collar 134 secured to the end of the flue gas exit pipe 40 of the fireplace and the flue gas outlet pipe 116 inside the plate 106 of the vent cap assembly.

To install the fireplace during one visit to the job site during the framing of the structure, the installer merely mounts the wall box 60 to the studs 76, 78 by nailing the plate 72 thereto with the box between the studs, and installs the vent cap assembly to the wall box. After the air inlet assembly 62 and flue gas assembly 64 are attached to the fireplace the installer locates the fireplace against the interior wall and the plate 72 of the wall box and secures it in place by pushing the vent cap assembly until the gas tube 128 has received the outlet pipe 116 and the air tube 122 has received the air tube extension 98 of the air inlet tube 96. Inlet air can thus enter the perforations 98 and flow into the air box 42 of the fireplace and hot flue gases can exit the fire box through the flue gas assembly which communicates with the baffles of the vent cap assembly. An exterior wall contractor may later build up the outer wall 35 to the level of the plate 88 and the tabs 82 on the rear of the wall box 60 and provide a water proof seal between the exterior wall and the assembly.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A mounting assembly for a direct vent fireplace for permitting said fireplace to be installed within a building structure adjacent a wall that has been framed with conventional vertical support studs spaced one from the other before an exterior wall adjacent said studs has been constructed, said fireplace having a firebox for receiving fresh inlet air and generating combustion products including flue gas, means including an air inlet pipe communicating with said fire box for supplying fresh air, and means including an exhaust pipe communicating with said fire box for exhausting said flue gas, said mounting assembly comprising: a vent cap assembly including first and second spaced apart plates, a hollow air tube secured to both of said plates and extending through at least said first plate, said air tube having a periphery including perforations communicating with the interior of said tube for passing air from the exterior of said tube to the interior of said tube, said vent cap assembly further comprising a flue pipe having a central axis and a plurality of plate means communicating with said flue pipe and defining a flue gas baffle for directing flue gas transverse to said axis, means for fastening said baffle to said second plate with said flue pipe disposed within said air inlet tube, a hollow wall box having a first end and a second end, a mounting plate secured to said first end of said wall box, an aperture in said mounting plate communicating with the interior of said wall box, means for securing said mounting plate to a pair of said spaced apart studs in said building structure with said aperture and said wall box disposed intermediate said pair of studs, means for securing said first plate to said second end of said wall box to support said vent cap assembly on said wall box, exhaust gas conduit means extending through said wall box for connecting said flue pipe with said exhaust pipe, and air conduit means extending through said wall box for connecting said air tube with said air inlet pipe.

2. A mounting assembly for a direct vent fireplace as recited in claim 1, wherein said wall box comprises two boxes, one of said boxes being telescopically receivable within the other, and means for connecting said boxes together with said first end selectively spaced from said second end.

3. A mounting assembly for a direct vent fireplace as recited in claim 2, wherein said exhaust gas conduit means comprises a pair of conduits telescopically connected together to a selected length, and said air conduit means comprises a pair of conduits telescopically connected together to a selected length.

* * * * *